United States Patent [19]

Takahashi et al.

[11] Patent Number: 4,792,781

[45] Date of Patent: Dec. 20, 1988

[54] CHIP-TYPE RESISTOR

[75] Inventors: Tetsuo Takahashi; Eisaku Miyauchi; Masayuki Yoshida; Shunichi Kumagai; Akio Sasaki, all of Tokyo, Japan

[73] Assignee: TDK Corporation, Japan

[21] Appl. No.: 15,282

[22] Filed: Feb. 17, 1987

[30] Foreign Application Priority Data

| | | | |
|---|---|---|---|
| Feb. 21, 1986 | [JP] | Japan | 61-36627 |
| Mar. 3, 1986 | [JP] | Japan | 61-44090 |
| Jan. 12, 1987 | [JP] | Japan | 62-4473 |

[51] Int. Cl.[4] ..... H01C 1/012

[52] U.S. Cl. ..... 338/307; 338/308; 29/610.1

[58] Field of Search ..... 338/306, 307, 308, 309; 29/610; 361/400, 403

[56] References Cited

U.S. PATENT DOCUMENTS

| | | | |
|---|---|---|---|
| 3,742,120 | 6/1973 | Keister et al. | 338/309 X |
| 4,204,187 | 5/1980 | Kakuhashi et al. | 338/307 |
| 4,684,916 | 8/1987 | Ozawa | 338/308 |

*Primary Examiner*—E. A. Goldberg
*Assistant Examiner*—M. N. Lateef
*Attorney, Agent, or Firm*—Steinberg & Raskin

[57] ABSTRACT

A chip resistor having configuration and dimensions of high precision and capable of operating with high reliability. The chip resistor includes end electrodes deposited on both side end surfaces of an insulating substrate according to a thin film deposition technique and integrally formed into a substantially C-shape so as to continuously and thoroughly cover the side end surfaces of the substrate. A resistance element may be formed according to either a thick film deposition technique or a thin film deposition technique. Also, a method for manufacturing such a chip resistor is provided.

29 Claims, 7 Drawing Sheets

CHIP-TYPE RESISTOR

BACKGROUND OF THE INVENTION

1. Field of the Invention

This invention relates to a chip resistor, and more particularly to a lead-less chip resistor which is adapted to be mounted as a chip-type electronic element on a printed circuit board.

2. Description of the Prior Art

Conventionally, a chip resistor has been typically manufactured in a manner to form a resistance element or film on a chip-like insulating substrate by screen printing and then form end electrodes on both side end surfaces of the substrate. The end electrode has been conventionally formed according to a thick film deposition technique. More particularly, it is formed, for example, by applying Ag—Pd to the substrate and baking it, and then applying Ni, Pb—Sn (Sn) or the like thereto by plating. Accordingly, the conventional chip resistor is called a thick film-type chip resistor. Supply of such a chip resistor to a consumer is generally carried out by means of a chip charging magazine or chip carrying tape.

Manufacturing of the conventional chip resistor according to the thick film deposition technique, as briefly described above, is carried out by forming the resistance film on a single insulating substrate material by printing and baking, dividing the substrate into bar-shaped sections, carrying out application and baking of Ag—Pd on each of the bar-shaped sections to form the end electrodes thereon, and then dividing each of the bar-shaped section into chip units followed by plating of Ni, Pb—Sn (Sn) or the like on each of the chips, to thereby obtain the chip resistor.

Unfortunately, the conventional chip resistor manufactured as described above has a disadvantage that a failure in application of Ag—Pd on the substrate with high precision fails to provide configuration and dimensions of the final product with good precision. Also, baking of Ag—Pd causes a variation in resistance of the resistance film baked in the previous step and deteriorates temperature and high frequency characteristics of the resistance film. Further, the plating is carried out by immersing the chip in an acid or alkaline plating solution, accordingly, a failure in control of the plating highly adversely affects reliability of operation of the final product. Furthermore, the conventional chip resistor causes its manufacturing process to be highly complicated and troublesome because the operation of dividing the substrate material into the barlike sections is highly difficult.

In the conventional thick film-type chip resistor, as described above, a variation in resistance of the resistance film often occurs and temperature and high frequency characteristics of the resistance film are readily deteriorated. In order to avoid such disadvantages, the inventors tried to form the resistance film according to a thin film deposition technique such as sputtering, vacuum deposition, ion plating or the like. However, this failed to provide the end electrodes with satisfactory peel strength and heat resistance sufficient to exhibit good resistance to soldering.

Accordingly, it would be highly desirable to develop a chip resistor of which end electrodes can be manufactured according to a thin film deposition technique and which is capable of operating with high reliability.

SUMMARY OF THE INVENTION

Briefly speaking, in accordance with the present invention, a chip resistor is provided. The chip resistor includes a resistance element or film arranged on at least one surface of a chip-like insulating substrate and an end electrode deposited on each of side end surfaces of the substrate so as to be connected to the resistance element. The end electrodes each comprise a metal film formed into a substantially C-shape to cover the side end surface of the substrate according to a thin film deposition technique.

In accordance with another aspect of the present invention, a process for manufacturing such a chip resistor is provided. The process includes a step of providing a punched insulating substrate material which has a plurality of slit-like apertures formed in parallel with one another at predetermined intervals and a plurality of bar-like sections each provided between each adjacent two such slit-like apertures. The bar-like sections are formed integral with one another. The bar-like section is formed at each of predetermined positions of an upper surface thereof with a resistance element according to a thick film deposition technique. The process also includes a step of depositing end electrodes on each of side end surfaces of the bar-like section in a manner to positionally correspond to each of the resistance films according to a thin film deposition technique. The end electrodes each are formed into a substantially C-shape so as to cover the side end surface and be connected to the resistance element. Also, the process includes steps of separating the bar-like sections form one another and dividing each of the bar-like section into chip-like substrate units to obtain the chip resistor.

Alternatively, the process may be constructed to include steps of forming a resistance element or film on an insulating substrate material according to a thin film deposition technique so as to continuously cover a part of a lower surface, both side end surfaces and an upper surface of the insulating substrate material, and depositing an electrode film on the resistance element according to a thin film deposition technique. The electrode film is then subjected to etching to form a plurality of end electrodes of a substantially C-shape so as to cover each of the side end surfaces of the substrate material. Then, the resistance element is subjected to etching to form a predetermined pattern of the resistance element. Thereafter, the substrate material is divided into a plurality of chip-like substrate units to obtain the chip resistor.

In accordance with a further aspect of the present invention, there is provided an chip resistor assembly which includes a plurality of the above-described chip resistors arranged on a base plate in a predetermined positional relationship.

Accordingly, it is an object of the present invention to provide a chip resistor which is formed with end electrodes according to a thin film deposition technique.

It is another object of the present invention to provide a chip resistor which has its final configuration and dimensions of high precision.

It is a further object of the present invention to provide a chip resistor including a resistance film of which a variation in resistance is suppressed and temperature and high frequency characteristics are significantly improved.

It is still another object of the present invention to provide a chip resistor including an end electrode which is provided with satisfactory peel strength and heat resistance sufficient to exhibit good resistance to soldering.

It is yet another object of the present invention to provide a chip resistor assembly including a plurality of chip resistors which are capable of operating with high reliability.

It is still a further object of the present invention to provide a process for manufacturing a chip resistor which is capable of forming a chip resistor with end terminals according to a thin film deposition technique.

It is yet a further object of the present invention to provide a process for manufacturing a chip resistor which is capable of providing the chip resistor with end electrodes without dividing a substrate material.

Still other objects and advantages of the invention will be apparent from the specification.

The invention accordingly comprises the several steps and the relation of one or more such steps with respect to each of the others, and the device embodying features of construction, combinations of elements, and arrangement of parts which are adapted to effect such steps, all as exemplified in the following detailed disclosure.

BRIEF DESCRIPTION OF THE DRAWINGS

For a fuller understanding of the invention, reference is had to the following description taken in connection with the accompanying drawings in which like reference numerals designate like or corresponding parts throughout; wherein:

FIGS. 2 to 6 show steps of a process for manufacturing the chip resistor shown in FIG. 1, wherein FIG. 2 is a perspective view showing a punched insulating substrate material, FIG. 3 is a perspective view showing formation of resistance films, FIG. 4 is a perspective view showing formation of end electrodes, FIG. 5 is a front elevation view showing deposition of a first protective coating and FIG. 6 is a perspective view showing a chip resistor assembly;

FIGS. 8 to 15 show steps of a process for preparing the chip resistor shown in FIG. 7, wherein FIG. 8 is a schematic view showing a step of providing bar-like insulating substrate material, FIG. 9 is a perspective view showing a bar-like insulating substrate material obtained in the step shown in FIG. 8, FIG. 10 is a schematic view showing a step of forming a resistance element on the bar-like insulating substrate material of FIG. 9, FIG. 11 is a schematic front elevation view showing the bar-like insulating substrate material of FIG. 10 on which a resistance element has been formed, FIG. 12 is a schematic elevation view showing the bar-like insulating substrate material of FIG. 11 on which an electrode film has been formed, FIG. 13 is a schematic elevation view showing the bar-like insulating substrate material of FIG. 12 onto which a resist has been applied, FIG. 14 is a schematic elevation view showing the bar-like insulating substrate of FIG. 13 which has been subjected to etching, and FIG. 15 is a perspective view showing a manner of dividing the bar-like insulating substrate material of FIG. 14.

DETAILED DESCRIPTION OF THE PREFERRED EMBODIMENTS

Now, a chip resistor according to the present invention will be described hereinafter with reference to the accompanying drawings.

Figure 1:
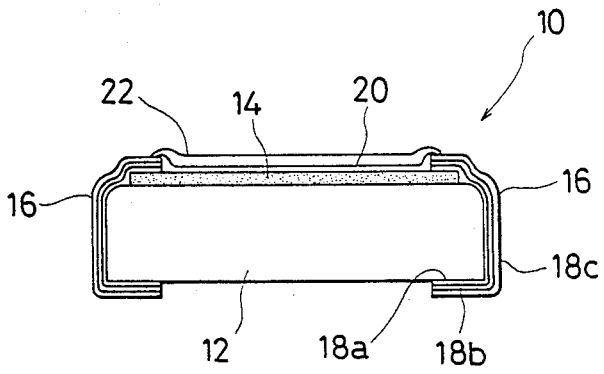
FIG. 1 is a front elevation view showing an embodiment of a chip resistor according to the present invention.

FIG. 1 shows an embodiment of a chip resistor according to the present invention, wherein a chip resistor of the illustrated embodiment is generally designated by reference numeral 10. The chip resistor 10 includes a chip-like insulating substrate 12 formed of a suitable insulating material such as alumina or the like and a resistance film or resistance element 14 formed of $RuO_2$ or the like and arranged on an upper surface of the insulating substrate 12. In the illustrated embodiment, the resistance film 14 is deposited on the substrate according to a thick film deposition technique such as screen printing or the like. The chip resistor 10 also includes an end electrode 16 formed on each of both side end surfaces of the insulating substrate 12 according to a thin film deposition technique such as sputtering, ion plating, P-CVD or the like. In the illustrated embodiment, the end electrodes 16 each are made of a three-layer metal film comprising a lower layer **18*a*, a middle layer 18*b* and an upper layer 18*c* deposited on the side end in order. The end electrode 16 is formed into a substantially C-shape so as to surround the side end and be connected to the resistance element 14. The lower layer 18*a* may be formed of metal capable of exhibiting satisfactory adhesion to the $RuO_2$ resistance film 14, for example, such as Cr, Ti, Ni—Cr alloy containing 30% by weight or more Cr, or the like. The middle layer 18*b* may be formed of metal capable of exhibiting good resistance to soldering, for example, such as Ni, Ni—Cr alloy, Ag—Ni alloy, Sn—Ni alloy or the like. The upper layer 18*c* maybe formed of metal capable of exhibiting good conformability to soldering, for example, such as Ag, Pb—Sn alloy, Sn or the like. In the illustrated embodiment, the layers 18*a*, 18*b* and 18*c* are formed of Cr, Ni and Ag, respectively. In addition, the chip resistor of the illustrated embodiment includes a first protective coating 20 applied to a surface of the resistance film 14 and formed of resin and a second protective coating 22 deposited on the coating 20 and formed of resin or glass, which serve to protect the resistance film 14**.

Now, manufacturing of the above-described chip resistor 10 will be exemplified hereinafter with reference to FIGS. 2 to 6.

First, a sheet-like insulating substrate material 24 is provided which is formed with a plurality of slit-like apertures 26 arranged parallel with one another at predetermined intervals. The substrate material 24 is divided into a plurality of bar-like sections 28 by the slits or apertures 26. Then, the substrate material 24 is subjected to a surface treatment sufficient to clean its surface.

Figure 3:
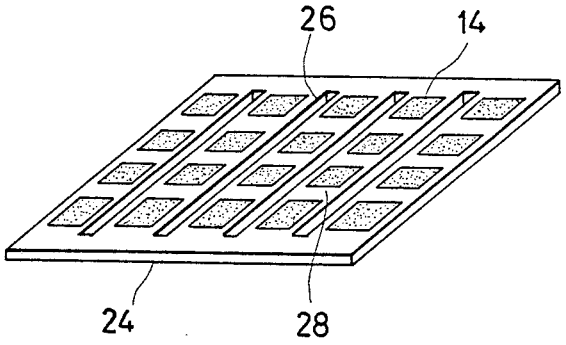

Subsequently, as shown in FIG. 3, the $RuO_2$resistance elements 14 are formed on each of the bar-like sections 28 at predetermined intervals by a thick film deposition technique. More particularly, resistance paste containing $RuO_2$ is applied to each of the bar-like sections 28 at predetermined intervals by screen printing and then subjected to drying and baking to prepare the resistance films 14. The baking may take place at 850° C.

Figure 4:
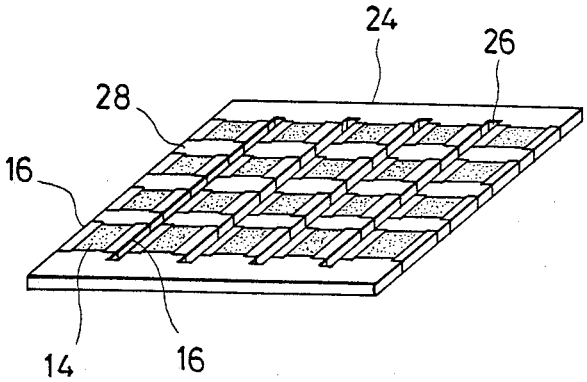
Figure 5:
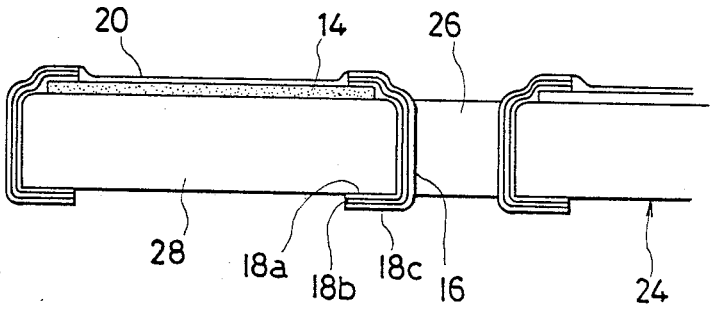

Then, as shown in FIGS. 4 and 5, the end electrodes 16 are formed on side end surfaces of each of the bar-like sections 28 at the predetermined intervals by depositing the Cr, Ni and Ag metal layers 18*a*, 18*b* and 18*c* in order on the side end surfaces according to a thin film deposition technique such as sputtering, ion plating, P-CVD or the like. Each of the metal layers 18*a*, 18*b* and 18*c*, as shown in FIG. 5, is formed into a substantially C-shape so that it may surround the side end surface of the bar-like section 28, an upper end thereof may cover an end of the resistance film 14 and an lower end thereof may reach a part of a lower surface of the bar-like section 28. Thus, it will be noted that the end electrode 16 is formed according to a dry and low temperature process. Then, the first protective coating 20 is formed on an exposed surface of the resistance film 14.

Figure 6:
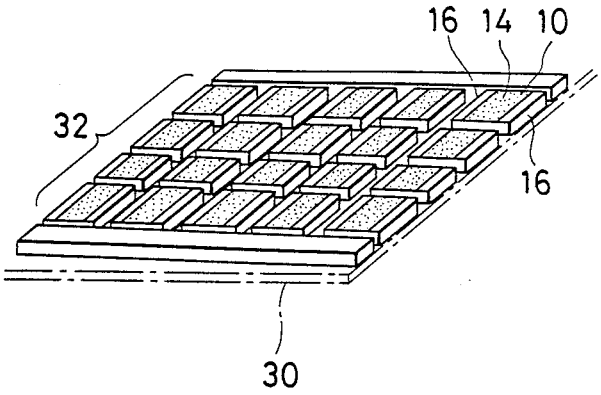

Thereafter, the punched substrate material 24 provided with the resistance films 14 and end electrodes 16, as shown in FIG. 6, is adhesively supported at a lower surface thereof on a base plate 30 and then each of the bar-like sections 28 is divided into chip-like substrate units to provide the chip resistors 10, so that a chip resistor assembly 32 comprising a plurality of the chip resistors 10 arranged at the predetermined intervals in a lateral direction in FIG. 6 may be formed. The chip resistors 10 are subjected to resistance adjustment in a state of the assembly 32 and then the second protective coating 22 is applied to each of the chip resistors 10. The so-prepared chip resistors may be supplied in the form of the assembly to a consumer. For the purpose of mounting each of the chip resistors on a printed circuit board, the chip resistors are dismounted from the base plate 30 to be separated from one another and charged in a magazine or carried on a tape.

As can be seen from the foregoing, in the illustrated embodiment, the end electrodes are deposited on the side end surfaces of the substrate according to a thin film deposition technique in the manner to surround the side end surfaces and be connected to the resistance element or thick film formed according to a thick film deposition technique. Such construction of the illustrated embodiment not only permits the final product to have configuration and dimensions of high accuracy and improves precision of resistance of the product because a dry and low temperature process can be employed but causes the product to be operated with high reliability because of eliminating a step of immersing the chip into an alkaline or acid plating solution. Further, the embodiment allows the chip resistor to be manufactured with ease because dividing of the substrate material into the substrates can be readily carried out.

Figure 7:
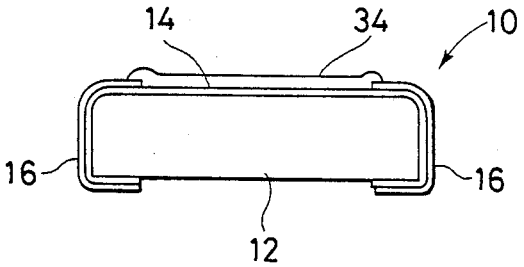
FIG. 7 is a front elevation view showing another embodiment of a chip resistor according to the present invention.

FIG. 7 shows another embodiment of a chip resistor according to the present invention. A chip resistor 10 of the embodiment includes an insulating substrate 12 and a resistance film 14 arranged on the substrate 12 so as to continuously cover a part of a lower surface, both side end surfaces and an upper surface of the substrate 12. The substrate 12 may be made of alumina or the like as in the embodiment shown in FIG. 1. In the illustrated embodiment, the resistance film 14 is formed according to a thin film deposition technique such as vacuum deposition, sputtering, ion plating or the like. The chip resistor 10 also includes and end electrode 16 made of a film deposited on each of the side end surfaces of the substrate 12. The end electrode 16 is formed according to such a thin film forming process as described above. In the illustrated embodiment, the end electrode 16 comprises a single-layer film. Formed on an exposed surface of the resistance film 14 is a protective coating 34 which is formed of resin or glass and serves to protect the resistance film 14.

Now, manufacturing of the chip resistor 10 shown in FIG. 7 will be described hereinafter with reference to FIGS. 8 to 15.

Figure 8:
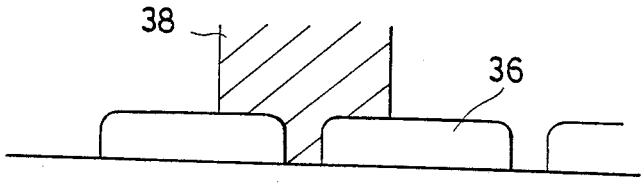
Figure 9:
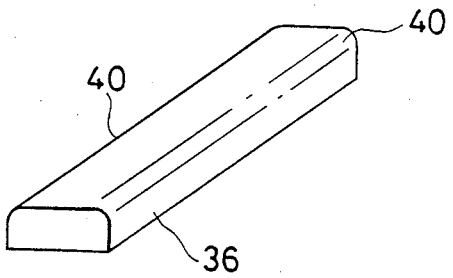

First, as shown in FIG. 8, a wide insulating plate material formed of alumina or the like is divided into a plurality of bar-like substrate materials 36 by means of a blade 38. The blade is preferably formed at a tip thereof into a shape which allows upper corners 40 of the bar-like substrate material 36 to be rounded as shown in FIGS. 8 and 9. When the corners are acute, a resist applied onto the substrate material in a subsequent etching step is often cut or broken. Formation of the rounded corners 40 prevents such damage of the resist. Alternatively, formation of such rounded corners may be carried out by extrusion. All corners of the substrate material 36 may be rounded.

Figure 10:
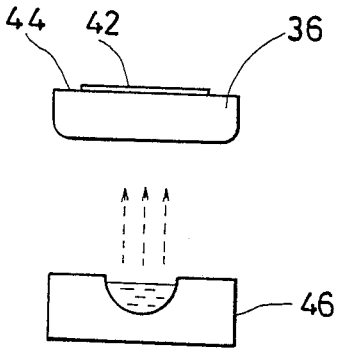
Figure 11:
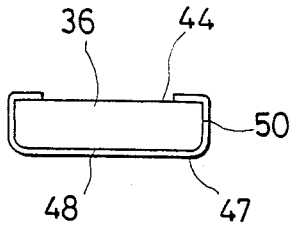

Then, as shown in FIG. 10, the bar-like substrate material 36 is inverted and a mask 42 is applied to a lower surface 44 of the material 36. Metal of high resistance such as Ni—Cr alloy is then vaporized from a crucible 46 and deposited on a surface of the substrate materials 36 except that covered with the mask 42 according to a thin film deposition technique such as vacuum deposition, sputtering, ion plating or the like, so that a resistance film material 47 which covers not only an upper surface 48 and both side end surfaces 50 of the substrate material 36 but a part of the lower surface 36 contiguous with the side end surfaces 50 may be continuously formed on the substrate material 36 as shown in FIG. 11. Adhesion of the resistance film 14 partially depends on composition of metal for the film. When Ni—Cr alloy is used for the film 14, it preferably contains 30% by weight or more Cr.

Figure 12:
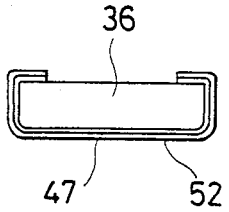

Then, as shown in FIG. 12, an electrode film 52 is deposited on the resistance film 47 according to such a thin film deposition technique as described above. The electrode film 52 may be made of copper, copper alloy or the like. Formation of the film 52 may be carried out in substantially the same manner as that of resistance film material 47.

Figure 13:
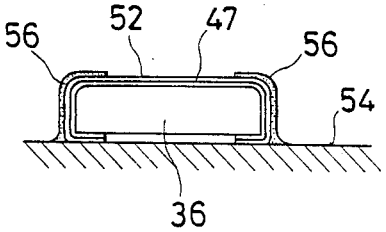
Figure 14:
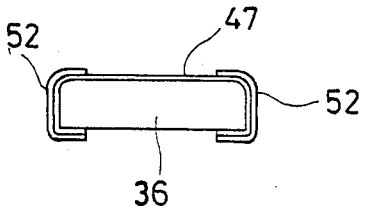

Subsequently, as shown in FIG. 13, the bar-like substrate material 36 is placed on a flat support plate 54 and a resist is applied to each of the side end surfaces 50 in a manner to surround it. Then, an unnecessary portion of the electrode film 52 which is not covered with the resists 56 is removed by etching, so that the end electrode 16 of a substantially C-shape which covers each of the side end surfaces 50 and portions adjacent thereto maybe formed, as shown in FIG. 14. Subsequently, unnecessary portions of the resistance film material 47 likewise are removed by etching, resulting in a plurality of the resistance films 14 each having predetermined resistance and a predetermined pattern being obtained as shown in FIG. 15.

Figure 15:
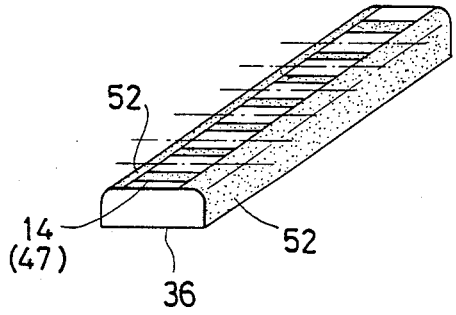

Finally, the bar-like substrate material 36 is divided into a plurality of the substrate units 12 in a manner as indicated at dashed lines in FIG. 15 and then the protective coating 34 is applied to each of the substrates 12, so that a plurality of the chip resistors 10 each shown in FIG. 7 may be obtained. The so-obtained chip resistor includes the insulating substrate 12, the resistance film 14 continuously deposited on the substrate 12 according to the thin film deposition technique so as to cover a part of the lower surface of the substrate as well as the upper and side end surfaces, and the end electrodes 16 deposited on the resistance film 14 according to the thin film deposition technique so as to cover both side ends of the substrate 12.

Figure 2:
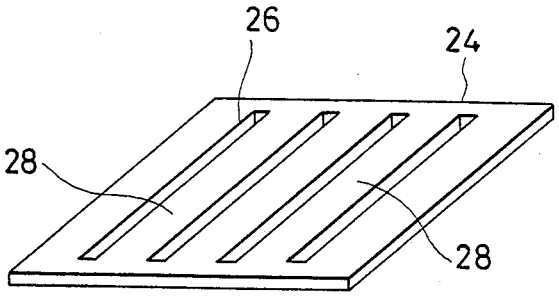

In the embodiment shown in FIG. 7, the bar-like substrate material is used. However, a punched substrate material as shown in FIG. 2 may be used for the embodiment. In this instance, a bar-like section 28 interposed between each adjacent two apertures 26 is subjected to the treatments shown in FIGS. 10 to 15 and then divided to obtain the chip resistors.

As can be seen from the foregoing, the chip resistor of the embodiment shown in FIG. 7 is capable of having resistance of high accuracy and exhibiting satisfactory temperature and high frequency characteristics because the resistance film is formed according to a thin film deposition technique. Accordingly, the chip resistor can be conveniently used as a circuit element for a microwave transmitter, a video equipment, an office automation equipment or the like. Also, the chip resistor is so constructed that the resistance film is formed to extend to the lower surface of the substrate. This causes the resistance film to be more firmly adhered to the substrate, so that the end electrode may be increased in peel strength and resistance to soldering. Further, formation of the end electrode is carried out according to a thin film deposition technique, resulting in the chip resistor having configuration and dimensions of high accuracy. This is advantageous in automatic mounting of the chip resistor on a printed circuit board. Furthermore, the chip resistor of the illustrated embodiment is suitable for mass-production and manufactured at a low cost.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

What is claimed is:

1. A chip resistor comprising:

a chip-like insulating substrate;

a resistance element arranged on at least one surface of said substrate;

an end electrode made of a metal film deposited on each of side end surfaces of said substrate according to a thin film deposition technique, said end electrode being integrally formed into a substantially C-shape so as to continuously and throughly cover each of said side end surfaces and be connected to said resistance element.

2. A chip resistor as defined in claim 1, wherein said resistance element comprises a thick film deposited according to a thick film deposition technique.

3. A chip resistor as defined in claim 2, wherein said resistance element is deposited on an upper surface of said substrate.

4. A chip resistor as defined in claim 2, wherein said end electrode comprises a three-layer film.

5. A chip resistor as defined in claim 4, wherein said end electrode comprises a lower layer formed of metal exhibiting good adhesion to said resistance element, a middle layer formed of metal having good resistance to soldering and, an upper layer formed of metal exhibiting good conformability to soldering.

6. The resistor of claim 5, wherein said lower layer is formed of Cr, Ti, or Ni—Cr containing at lease 30% by weight of Cr, said middle layer is formed of Ni, Ni—Cr alloy, Ag—Ni alloy, or Sn—Ni alloy, and said upper layer is formed of Cr, Ni, or Ag.

7. The resistor of claim 2, additionally comprising a first protective coating applied to a surface of said resistance element, and a second protective coating deposited on a surface of said first protective coating.

8. The resistor of claim 7, wherein said first protective coating is formed of resin, and said second protective coating is formed of glass or resin.

9. A chip resistor as defined in claim 1, wherein said resistance element comprises a thin film deposited according to a thin film deposition technique.

10. A chip resistor as defined in claim 9, wherein said resistance film is continuously deposited on an upper surface, both side end surfaces and a part of a lower surface of said substrate.

11. A chip resistor as defined in claim 9, wherein said end electrode comprises a single layer film.

12. The resistor of claim 9, additionally comprising a protective coating situated on said resistance element.

13. The resistor of claim 12, wherein said protective coating is formed of resin or glass.

14. The resistor of claim 9, wherein said resistance element is formed of Ni—Cr alloy containing at least 30% by weight of Cr.

15. The resistor of claim 9, wherein said electrode is formed of copper or copper alloy.

16. The resistor of claim 1, wherein said substrate is formed of alumina, and said resistance element is formed of $RuO_2$.

17. A chip resistor comprising:

a chip-like insulating substrate;

a resistance element deposited on an upper surface of said substrate according to a thick film deposition technique; and an end electrode comprising a metal film deposited on each of side end surfaces of said substrate according to a thin film deposition technique, said end electrode being integrally formed into a substantially C-shape so as to continuously and thoroughly cover each of said side end surfaces and be connected to said resistance element.

18. A chip resistor comprising:

a chip-like insulating substrate;

a resistance element formed on said substrate according to a thin film deposition process so as to continuously cover an upper surface, both side end surfaces and a part of lower surface of said substrate; and end electrodes made of a metal film deposited on said resistance film according to a thin film deposition technique, said end electrodes each being integrally formed into a substantially C-shape so as to continuously and thoroughly cover each of said side end surfaces.

19. A chip resistor assembly comprising:

a base plate; and a plurality of chip resistors arranged on said base plate in a predetermined positional relationship;

said chip resistors each comprising a chip-like insulating substrate, a resistance element deposited on an upper surface of said substrate according to a thick film deposition technique, and an end electrode comprising a metal film deposited on each of side end surfaces of said substrate according to a thin film deposition technique and integrally formed into a substantially C-shape so as to continuously and thoroughly cover each of said side end surfaces and be connected to said resistance element.

20. A process for manufacturing a chip resistor comprising the steps of:

providing a punched insulating substrate material which has a plurality of slit-like apertures formed in parallel with one another at predetermined intervals and a plurality of bar-like sections provided between respective adjacent two said slit-like apertures and formed integral with one another;

forming a resistance element on each of predetermined positions of an upper surface of each of said bar-like sections of said substrate material according to a thick film deposition technique;

depositing end electrodes on each of side end surfaces of each of said bar-like sections of said substrate material in a manner to positionally correspond to each of said resistance element according to a thin film deposition technique, said end electrodes each being integrally formed into a substantially C-shape so as to continuously and thoroughly cover each of said side end surfaces and be connected to said resistance element;

separating said bar-like sections from one another; and dividing each of said separated bar-like sections into chip-like substrate units to obtain said chip resistor.

21. The process of claim 20, wherein said resistance element is formed by the steps of applying resistance paste to each of said bar-like sections at predetermined intervals by screen printing, and then subjecting the thus-applied sections to drying and baking.

22. The process of claim 20, comprising the additional step of applying a protective coating on said resistance element after depositing said electrodes.

23. The process of claim 22, comprising the addition step of applying a second protective coating to each of the units after the dividing of the bar-like sections.

24. A process for manufacturing a chip resistor comprising the steps of:

forming a resistance element on an insulating substrate material according to a thin film deposition technique so as to continuously cover an upper surface, both side end surfaces and a part of a lower surface of said insulating substrate material;

depositing an electrode film on said resistance element according to a thin film deposition technique;

subjecting said electrode film to etching to form end electrodes each of which is integrally formed into a substantially C-shape so as to continuously and thoroughly cover each of side end surfaces;

subjecting said resistance element to etching to form predetermined patterns of said resistance element; and dividing said substrate material into a plurality of chip-like substrate units to obtain said chip resistor.

25. A process as defined in claim 24, wherein said insulating substrate material is formed into a bar-like shape.

26. A process as defined in claim 24, wherein said insulating substrate material is a punched insulating substrate material.

27. The process of claim 24, wherein said resistance element is formed by the steps of providing said substrate material with upper, rounded corners, inverting said substrate material and applying a mask to a lower surface thereof, and vaporizing high resistance metal from a crucible so that said vaporized metal becomes deposited upon a surface of said substrate material, except for a part covered by said mask.

28. The process of claim 24, wherein said substantially C-shaped electrodes are formed by the steps of placing said bar-like substrate material, after said depositing of said electrode film thereon, on a support plate, applying a resist to the side and surfaces, and then removing the electrode film not covered by said resist by subjecting the same to said etching.

29. The process of claim 24, comprising the additional steps of applying a protective coating onto each of said divided units.

* * * * *